US008028612B2

(12) United States Patent
Neal

(10) Patent No.: US 8,028,612 B2
(45) **Date of Patent: *Oct. 4, 2011**

(54) TRANSPARENT BALLISTIC RESISTANT ARMOR

(75) Inventor: Murray L. Neal, Fresno, CA (US)

(73) Assignee: American Development Group International, LLC, Washington, DC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/723,104

(22) Filed: Mar. 12, 2010

(65) Prior Publication Data

US 2011/0017053 A1 Jan. 27, 2011

Related U.S. Application Data

(63) Continuation of application No. 11/601,317, filed on Nov. 16, 2006, now Pat. No. 7,681,485.

(51) Int. Cl.
*F41H 5/02* (2006.01)

(52) U.S. Cl. ..... 89/36.02; 89/36.01; 89/36.04; 89/905

(58) Field of Classification Search ..... 89/36.01, 89/36.02, 36.04, 36.11, 36.12, 36.16
See application file for complete search history.

(56) References Cited

U.S. PATENT DOCUMENTS

| | | | |
|---|---|---|---|
| 3,634,177 | A | 1/1972 | Glaser et al. |
| 3,917,891 | A | 11/1975 | Cooke |
| 4,029,755 | A | 6/1977 | Gazza et al. |
| 4,130,684 | A | 12/1978 | Littell et al. |
| 4,719,151 | A | 1/1988 | Chyung et al. |
| 4,739,690 | A | 4/1988 | Moskowitz |
| 4,836,084 | A | 6/1989 | Vogelesang et al. |
| 5,002,820 | A | 3/1991 | Bolton et al. |
| 5,227,241 | A | 7/1993 | Chaussade et al. |
| 5,326,606 | A | 7/1994 | Labock |
| H1519 | H | 3/1996 | Semple |
| 5,496,640 | A | 3/1996 | Bolton et al. |
| 5,506,051 | A | 4/1996 | Levy-Borochov et al. |
| 5,515,541 | A | 5/1996 | Sacks et al. |
| H1567 | H | 8/1996 | Parsons et al. |
| 5,705,764 | A | 1/1998 | Schade et al. |
| 6,009,789 | A | 1/2000 | Lyons |
| 6,035,438 | A | 3/2000 | Neal et al. |
| 6,170,378 | B1 | 1/2001 | Neal et al. |
| 6,253,655 | B1 | 7/2001 | Lyons et al. |
| 6,334,382 | B2 | 1/2002 | Gourio |
| 6,370,690 | B1 | 4/2002 | Neal |
| 6,510,777 | B2 | 1/2003 | Neal |
| 6,708,595 | B1 | 3/2004 | Chaussade et al. |
| 6,745,661 | B1 | 6/2004 | Neal et al. |

(Continued)

OTHER PUBLICATIONS

PCT International Search Report, International Application No. PCT/US2007/022935, International Filing Date Oct. 30, 2007, completion date Nov. 5, 2008, mailed Nov. 18, 2008, 14 pages. Neal, Murray L., "Lightweight Fabric Based Body Armor", U.S. Appl. No. 10/238,096, filed Sep. 10, 2002, 33 pages.
Patel, Parimal J., et al., "Transparent Armor", The AMPTIAC Newsletter, Fall 2000, vol. 4, No. 3, Advanced Materials and Processes Technology, (2000), pp. 1-19.

*Primary Examiner* — Bret Hayes
*Assistant Examiner* — Michael D David
(74) *Attorney, Agent, or Firm* — Blakely Sokoloff Taylor & Zafman LLP

(57) ABSTRACT

A laminated, optically transparent, ballistic resistant structure is described as having a first transparent layer, a second transparent layer of ceramic tiles spread across the first layer, and a third transparent layer. The first and third layers are bonded to opposite sides of the second layer, respectively, by transparent adhesive. Other embodiments are also described and claimed.

21 Claims, 4 Drawing Sheets

U.S. PATENT DOCUMENTS

| | | | | |
|---|---|---|---|---|
| 7,318,956 | B2 | 1/2008 | Labock | |
| 7,681,485 | B2 * | 3/2010 | Neal | 89/36.02 |
| 2003/0150321 | A1 | 8/2003 | Lucuta et al. | |
| 2003/0192426 | A1 | 10/2003 | Peretz | |
| 2003/0221547 | A1 | 12/2003 | Peretz | |
| 2006/0060077 | A1 | 3/2006 | Lucuta et al. | |
| 2006/0249012 | A1 | 11/2006 | Sarva et al. | |
| 2007/0068375 | A1 | 3/2007 | Jones et al. | |
| 2007/0068376 | A1 | 3/2007 | Jones et al. | |
| 2008/0047418 | A1 | 2/2008 | Warren et al. | |
| 2008/0090716 | A1 | 4/2008 | Cherepy et al. | |
| 2009/0114083 | A1 * | 5/2009 | Moore et al. | 89/36.02 |

* cited by examiner

TRANSPARENT BALLISTIC RESISTANT ARMOR

CROSS-REFERENCE TO RELATED APPLICATIONS

This application is a continuation of application Ser. No. 11/601,317, filed Nov. 16, 2006.

FIELD

An embodiment of the invention relates to a transparent ballistic resistant structure, namely, one that has a multi-layered or laminated structure composed of an intermediate or middle panel made of transparent ceramic tiles, sandwiched by glass panels. Other embodiments are also described.

BACKGROUND

All law enforcement, peacekeeping and military communities are often faced with the need to observe potentially hostile environments through protective shielding of some configuration. Transport vehicles such as aircraft, vehicles or vessels often suffer in adequate protection from ballistic and fragmentation threats through the windshields and surrounding windows and/or view ports. Protection of all vehicles in the combat theater has become a seriously realized requirement over the past few years due to urban deployments where typical ballistic stand-off distances are no longer afforded, and improvised explosive devices are becoming more prevalent. Some of the personal protection applications of transparent armor would be protective visors, guard shack glazings, transport vehicle, vessel and aircraft applications, currency transport vehicles, medical, communications and scientific research and development transparency applications.

The current existing transparent armor systems are typically comprised of several layers of either of the following materials: glass, polycarbonate or acrylic, adhered together by polyvinyl butylral (PVB) or urethane adhesive interlayers. The resulting armor structure can have multiple layers of the same material, or it may use a combination of any of the three depending upon the primary and any other secondary threat considerations. The four most utilized transparent ballistic and fragmentation resistant armor materials are as follows.

Bullet resistive glass laminates are relatively heavy and thick, and are manufactured with multiple layers of annealed glass, and polyvinyl butylral (PVB) interlayers from 0.015 inches to 0.120 inches thick. They can pass ballistic and fragmentation ratings and are generically not required to eliminate spall. Anti-spalling components have to be added to the existing already thick glazing, on the rear or protected side. Once attacked, the glass unit will become cracked and partial glass loss to either side will be noticed depending upon whether no spalling or low spalling is specified. Spalling is the exit of glass toward the protected or safe side during an attack, regardless of projectile penetration/access. Typical no-spalling materials utilized are polycarbonate sheet attached to the safe side of the transparent armor system, or a two part film composite manufactured from a 7 to 10 mil thick polyethylene terepthalate (PET) facing film with a 15 or 30 mil (thousandths of an inch) thick polyvinyl butylral (PVB) primary adhesive attached to the safe side of the transparent armor system.

Acrylics are lightweight synthetic materials with excellent optical clarity and a high degree of break resistance. They do offer limited ballistic resistance. However, acrylic glazing materials are highly combustible thermoplastics, and as such, support flames and emit toxic fumes when burned. They are also extremely susceptible to a loss of clarity through scratching, gouging and ultraviolet (UV) exposure. Acrylics once attacked exhibit large cracking and loss of the acrylic material especially during ballistic and heavy fragmentation attacks.

Polycarbonates are lightweight synthetic materials with many times the break resistance of equal thicknesses of plate glass with excellent optical clarity. Similar to acrylics, polycarbonates are susceptible to a lesser degree to scratching, gouging and yellowing from ultraviolet exposure. They too are not fire resistant and emit toxic fumes when burned, but are much more difficult to ignite, and generally have the capability to self-extinguish once flame is removed. Polycarbonates once attacked may show signs of slight delamination between layers directly surrounding a ballistic/fragmentation attack, and will encapsulate the bullet, depending upon composition and speed.

Glass-clad polycarbonates are composite glazings made by sandwiching a polycarbonate sheet between laminations of glass and PVB or urethanes; or by laminating a polycarbonate sheet to the backside of laminated glass as an anti-spall shield.

More recently, transparent ceramics (also referred to in some circles as glass-ceramics) have been showing significant ballistic performance capabilities at substantially reduced weights and overall thicknesses over the conventional glass/plastic systems. Polymeric material advancements, such as improvements in the optical properties of polyurethanes, have shown promise in their combined use with ceramics for further reductions in the overall weight of the finished transparent systems.

Both current and future requirements of military and peacekeeping organizations will involve regular combat actions in urban hostile environments, where single vehicles or supply convoys are at much at risk as organized troop formations. This brings with it the realization that all military and security personnel are at risk. There is also a need for reduced logistical burden in the theatre of operation, such that there is a continued strive for transportation systems that possess reduced weight and operational costs, with increased maneuverability and payload capability. This can be made possible by reducing the weight burden of the armor components. Preferably, such armor components should also not be overly thick, and should have the capability to withstand multiple repeat hits.

BRIEF DESCRIPTION OF THE DRAWINGS

The embodiments of the invention are illustrated by way of example and not by way of limitation in the figures of the accompanying drawings in which like references indicate similar elements. It should be noted that references to an or "one" embodiment of the invention in this disclosure are not necessarily to the same embodiment, and they mean at least one.

DETAILED DESCRIPTION

Figure 1:
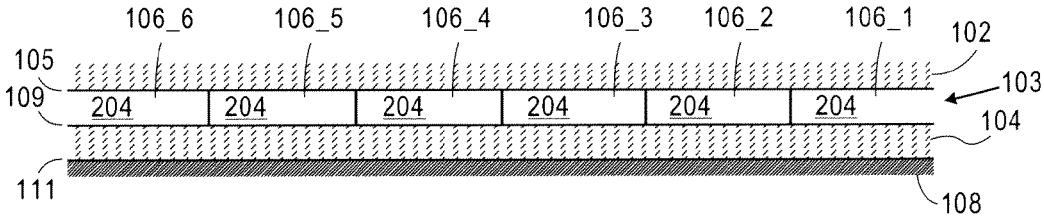
FIG. 1 is an edge view of a transparent ballistic resistant structure, in accordance with a first embodiment of the invention.

In accordance with an embodiment of the invention, a laminated, transparent (at least in the visible spectrum) ballistic resistant structure is described that has an intermediate or middle layer of transparent ceramic tiles. The tiles are spread across respective, transparent layers that are bonded to opposite sides of the intermediate layer. A transparent adhesive, whose index of refraction is selected to match that of the transparent layers, for improved overall transparency of the structure, may be used to bond the different layers together, front to back. In addition, another adhesive, also with a matching index of refraction, is used to bond the tiles to one another, within and across the intermediate layer. At least three different embodiments of the such a structure will be described below.

Some of the advantages that may be available in the embodiments of the invention described below are as follows: First, ballistic protection is available in two classes, namely 7.62 mm caliber, and HMG 12.7 mm and 14.5 mm. In addition, fragmentation protection may be provided by each of the embodiments, at up to 25 mm caliber. Such combination protection is provided with reduced weight and thickness, as compared to conventional security glazings. In addition, an improvement in multiple repeat hit capabilities has also been observed relative to conventional designs. Such ballistic performance has been obtained with reduced distortion and obscurity of the viewing area around the impact locations, thus permitting continued unobstructed visibility even after a projectile impact. Selection of materials that make up the different layers also provide for compatibility with night vision equipment (in addition to, of course, transparency in the visible frequencies). Overall light transparency has also proved to be not only obtainable, but may also be improved relative to conventional multilayer glass security glazings.

Any reference here to "transparent" is intended to mean at least visually transparent, that is transparent in the visible frequencies of the electromagnetic spectrum. A typical window glass, for example, is transparent in the visible frequencies, while a radome (used to house rotating radar units) is transparent to radar frequencies and may not be required to be transparent in any visible frequencies.

Any reference here to "ballistic resistant" is intended to mean at least having the ability to defeat a bullet fired from a gun, in accordance with any one, or all, of the Level III threats listed below (which may be as defined in National Institute of Justice (NIJ) 0108.01 or in Mil-Std-662F. Use of the term "ballistic" here does not preclude the ability to provide fragmentation protection, such as defined in Mil-P-46593A (e.g., calibers 0.22, 0.3, 0.5, and 20 mm.). Additional definitions for Level IV and higher threats are also given below.

The resulting ballistic resistant structure is rigid, obtained in one case by the lamination of what are separately formed and essentially solid layers. Each layer is sufficiently transparent in the visible spectrum so as to provide a needed overall transparency requirement for the structure. This transparency may be defined in terms of light transmission characteristics, and haze, for the overall structure. Even when looking into the structure at a diagonal (rather than perpendicular or head-on), the structure is likely to not cause too much distortion, provided the tiles are polished and the adhesive layers are correctly selected and applied. The composition of the different layers to promote transparency, as well as, of course, to provide for ballistic resistance, are described below.

In a preferred embodiment of the invention, the intermediate layer is sandwiched by what are essentially glass layers. Glass may be viewed as an amorphous solid with the structure of a liquid. Typically, glass has been super cooled at a rate too high to allow crystals to form. It may also be defined as an inorganic product of fusion that has cooled to rigid condition without crystallization. Glass typically contains at least 50 percent silica, which is known as a glass former. Certain properties of glass may be modified by the addition of oxides of aluminum, sodium, calcium, barium, boron, magnesium, titanium, lithium, lead, and potassium. Depending upon their function, these oxides are considered intermediates (modifiers). For practical purposes, the behavior of glass is regarded as perfectly inelastic and brittle. The hardness of typical glass may be approximately 350 HK to 500 HK (Knoop Hardness). Glass with lower iron content is more transparent, however, it is not as strong (and thus perhaps requiring a greater thickness).

Although glass is considered amorphous, transparent ceramics (also referred to here as glass ceramics) have a high crystalline component to their microstructure. In forming glass, crystallization is to be prevented, whereas in the processing of transparent ceramics, crystallization of desired phases and crystal morphologies is to be promoted. Transparent ceramics may contain large proportions of several oxides, and their properties may be a combination of those of glass and ceramics. Hardness of some, typical transparent ceramics may range from 520 HK to 650 HK, but can be much higher (as mentioned below). The properties of transparent ceramics may be changed by modifying the composition of the material and by using heat treatment. The optical properties of the material can be controlled by using various formulations and by controlling the structure, for example, to impart different degrees of transparency and different colors. As an example, single crystal sapphire (single crystal aluminum oxide) is considered highly transparent. In fact, the glass panels used in the different embodiments of the invention are likely to exhibit lower transparency as compared to the transparent ceramic and adhesive layers used.

Currently, there are three transparent crystalline ceramics that have substantial promise for improved transparent armor applications. One is magnesium aluminate spinel ($MgAl_2O_4$), commonly referred to as "Spinel", aluminum oxynitride ($AL_{23}O_{27}N_5$), commonly referred to as "ALON™", and single crystal aluminum oxide ($AL_2O_3$), commonly referred to as "Sapphire". The table below provides some relevant physical and mechanical properties of several glasses and transparent ceramics that may be used in different embodiments of the invention.

TABLE 1

Physical/Mechanical Properties of Transparent Glasses and Ceramics

| Property | Units | ALON (ceramic) | Fused Silica (glass) | Sapphire (grown ceramic) | Spinel (synthetic) | Zinc Sulfide (ceramic) |
|---|---|---|---|---|---|---|
| Density | $g/cm^3$ | 3.69 | 2.21 | 3.97 | 3.59 | 4.08 |
| Area Density (at 1" thickness) | $lb/ft^2$ | 19.23 | 11.44 | 20.68 | 18.61 | 21.20 |
| Young's Elastic Modulus | GPa | 334 | 70 | 344 | 260 | 10.7 |
| Mean Flexure Strength | MPa | 380 | 48 | 742 | 184 | 103 |
| Fracture Toughness | MPa m | 2.4 | 1.2 | 3.2 | 1.7 | 0.8 |

TABLE 1-continued

| Physical/Mechanical Properties of Transparent Glasses and Ceramics | | | | | | |
|---|---|---|---|---|---|---|
| Property | Units | ALON (ceramic) | Fused Silica (glass) | Sapphire (grown ceramic) | Spinel (synthetic) | Zinc Sulfide (ceramic) |
| Knoop Hardness ($HK_2$) | GPa | 17.7 | 4.5 | 19.6 | 14.9 | 2.45 |

The currently preferred material for the tiles is sapphire. A typical hardness of single crystal sapphire is approximately 1,300 HK. It is a transparent ceramic that possesses a rhombohedral crystal structure. From a production and application perspective, sapphire is currently a mature transparent ceramic. However, it is relatively high in cost due to the needed high processing temperatures and machining and polishing steps. Sapphire exhibits high strength, but its clarity and transparency are still highly dependent on the surface finish.

Referring now to FIG. 1, an edge view of a laminated transparent ballistic resistant structure, in accordance with the first embodiment of the invention is shown. The laminated structure is composed of the following layers, starting from the strike face (threat side) at the front, and moving towards the protected or safe side at the rear. For ease of fitting the structure into a window framing system, all of the below-described layers should have co-extensive peripheries (as shown in the figures). The first layer 102 essentially consists of a panel of annealed glass. The glass panel helps preclude scratching, marring or gouging of the intermediate layer 103 that is behind it. This helps avoid premature failure mechanisms in the front face of the intermediate layer 103 which, as explained below, is essentially a rigid, solid panel having a number of transparent crystalline ceramic tiles bonded to one another to form the rigid panel, all across the area of a face of the first layer 102 or third layer 104. The use of a glass panel in the first layer 102 also helps in maintaining the configuration or arrangement of the tiles in the intermediate layer 103, by maintaining a sandwiched configuration that retains the tiles in place (along with the use of appropriate adhesives) during projectile impact. The glass panel also helps maintain the ceramic tiles in their fixed locations, in the presence of thermally induced expansion or contraction of the transparent armor structure. Annealed glass is preferred for water vessels and buildings instead of heat strengthened, chemical strengthened, or tempered glass, due to its better resistance to fragmentation or shrapnel. However, heat or chemical strengthened glass could also be used especially for land vehicles and aircraft, if they could also break into larger shard-like pieces, rather than smaller, "¾ minus" pieces indicated by tempered glass. More generally, the materials selected for the make up of the first layer 102 should reduce the pliability of the structure as a whole, which would otherwise subject the structure to fallout from the window frame system (not shown) in which the structure is rigidly held. This might occur in the presence of multiple repeat hits, or when subjected to an explosive blast over pressure, such as from a bomb or an improvised explosive device (IED).

In the embodiment of FIG. 1, the next structural layer is the intermediate layer 103. This layer may first be formed as a separate, rigid panel, and then its front face can be bonded to the back face of the first layer 102 via an adhesive layer 105. Depending upon the embodiment, the adhesive used in the layer 105 (as well as any other adhesive layers of the structure described below) may be selected from the following: polyvinyl butylral (PVB), urethane, acrylic composition, silicone composition, or a polyurethane.

The intermediate layer 103 may consist of a single, rigid panel made of transparent ceramic tiles 106_1, 106_2, . . . . The term "tile" as used here is not limited to a square or rectangular piece, but also encompasses polygons more generally, as well as disks. All of the edges of each interior tile, i.e. not located at the boundary of the overall structure, should be sufficiently polished, to impart greater transparency to the overall structure. In the first embodiment, the tiles 106 are transparent ceramic squares, whereas in the second and third embodiments they are disks. In the first embodiment, the transparent ceramic tiles 106 are preferably made essentially of sapphire. Each tile 106, referring now to FIG. 2 which is a top view of the first embodiment, has four edges 201-204. The arrangement of the tiles in this embodiment is mosaic-like, where none of the tiles 106 overlaps with another. More particularly, the tiles 106 in this case abut one another at their edges, to essentially eliminate any intervening spaces between them, making the intermediate layer 103 an essential solid of transparent ceramic. In this case, considering, for example, tiles 106_1 and 106_2, the left edge 203 of tile 106_1 abuts the right edge 201 of tile 106_2. The edges 201-204 are preferably polished to help improve transparency of the overall structure. A relatively thin layer 205 of adhesive is used to bond two abutting edges to each other. Note that this layer 205 and the abutting tiles should have indices of refraction that are matched, for improved transparency of the overall laminated structure, particularly at oblique viewing angles.

To make the mosaic structure easier to manufacture consistently, each of the tiles 106 should have essentially the same dimensions. In the first embodiment depicted in FIGS. 1 and 2, the resulting structure has a single intermediate layer 103 in which there are 36, 2"×2" square tiles 106 arranged in the mosaic-like pattern as shown. Arrangements with greater or fewer numbers of tiles 106 are possible, which result in structures having larger or smaller face areas, respectively. This particular arrangement provides a protected area of 36×4=144 square inches. The first layer 102 should also preferably have the same area, in this case obtained using a single piece of 12"×12" glass panel. Smaller or larger sizes are, of course, possible.

When the layer 103 consists of a single layer of tiles 106 that are arranged in a planar, mosaic pattern as shown, the thickness of each tile 106 may be 5 mm to 10 mm for protecting against Level III ballistic threats, 7 mm to 12 mm for Level IV threats, 11 mm to 20 mm for Level V threats, 13 mm to 16 mm for 12.7 mm caliber ballistic threats, and 16 mm to 20 mm for defeating 14.5 mm caliber ballistic threats. These thickness recommendations are based on experimental results of tested ballistic resistant structures in accordance with the first embodiment, as summarized below. The thickness can vary, depending upon the number of backing layers in the third layer 104 (behind the transparent ceramic intermediate layer 103). This aspect, of using multiple backing layers in the third layer 104, is also applicable to the second and third embodiments of the invention.

Returning to FIG. 1 and the first embodiment, the back face of the layer 103 is bonded to a third layer 104, by another layer 109 of adhesive. The adhesive layer 109 may be spread across either the back face of the layer 103 and/or the front face of the layer 104. It serves to bond the transparent ceramic tiles 106 to the layer 104, which here is also referred to as a glass backing ply. The layer 104 may consist of multiple, stacked backing plies, or in effect sub-layers, each made preferably of glass.

The last layer of the structure, at the rear, is an anti-spalling layer 108. This layer 108 may consist of a single sheet of polycarbonate that has a thickness of 0.125 to 0.5 inch, depending upon the threat level to be defeated, the required multiple hit capability, and secondary threat requirements such as forced entry or explosive blast mitigation. The anti-spalling layer 108 serves to preclude any glazing entry to the safe side of the installation. The anti-spalling layer 108 may be bonded to the back face of the layer 104, by a further adhesive layer 111 that is designed to bond the material of the anti-spalling layer 108 to, for example, a backing ply of glass.

The following configurations of the first embodiment have been tested and have passed the noted threat levels (all thicknesses are in millimeters):

| Threat Level III | | |
|---|---|---|
| Layer | Example 1 Thickness | Example 2 Thickness |
| Glass #1 | 4.7 | 4.7 |
| Adhesive Layer | .030 | .050 |
| Ceramic #2 | 6.5 | 8.0 |
| Adhesive Layer | .060 | .060 |
| Glass #3 | 9.5 | 9.5 |
| Adhesive Layer | .030 | .030 |
| Glass #4 | 9.5 | 9.5 |
| Adhesive Layer | .030 | .030 |
| Glass #5 | 9.5 | 9.5 |
| Adhesive Layer | .025 | .050 |
| Polycarbonate #6 | 3.1 | 3.1 |

| Threat Level IV | | |
|---|---|---|
| Layer | Example 1 Thickness | Example 2 Thickness |
| Glass #1 | 6.3 | 6.3 |
| Adhesive Layer | .050 | .050 |
| Ceramic #2 | 8.5 | 10.0 |
| Adhesive Layer | .060 | .060 |
| Glass #3 | 9.5 | 9.5 |
| Adhesive Layer | .050 | .050 |
| Glass #4 | 9.5 | 9.5 |

-continued

| Threat Level IV | | |
|---|---|---|
| Layer | Example 1 Thickness | Example 2 Thickness |
| Adhesive Layer | .050 | .050 |
| Glass #5 | 9.5 | 9.5 |
| Adhesive Layer | .050 | .050 |
| Glass #6 | 9.5 | 9.5 |
| Adhesive Layer | .050 | .050 |
| Polycarbonate #7 | 3.1 | 3.1 |

| Threat Level V | | |
|---|---|---|
| Layer | Example 1 Thickness | Example 2 Thickness |
| Glass #1 | 6.3 | 6.3 |
| Adhesive Layer | .050 | .050 |
| Ceramic #2 | 11.0 | 14.0 |
| Adhesive Layer | .060 | .060 |
| Glass #3 | 9.5 | 9.5 |
| Adhesive Layer | .050 | .050 |
| Glass #4 | 9.5 | 9.5 |
| Adhesive Layer | .050 | .050 |
| Glass #5 | 9.5 | 9.5 |
| Adhesive Layer | .050 | .050 |
| Glass #6 | 9.5 | 9.5 |
| Adhesive Layer | .050 | .050 |
| Polycarbonate #7 | 3.1 | 3.1 |

Suitable descriptions of the different threat levels tested above are as follows. Note that the bullet types and velocities may be in accordance with NIJ Standard 0101.04 Performance Requirements, or other typical U.S. military standard specifications.

| LEVEL III | |
|---|---|
| Caliber and Bullet Type | Bullet Velocity |
| 7.62 × 63 mm 180 GR, SP | 2540 ft./sec. + 100-0 |
| 7.62 × 54 mm 147 GR, FMJ | 2786 ft./sec. + 100-0 |
| 7.62 × 54 mm 180 GR, FMJ | 2630 ft./sec. + 100-0 |
| 7.62 × 51 mm 148 GR, FMJ | 2780 ft./sec. + 30-0 |
| 7.62 × 39 mm 150 GR, FMJ | 2400 ft./sec. + 100-0 |
| 5.45 × 39 mm 54 GR, FMJ | 3000 ft./sec. + 100-0 |
| 5.56 × 45 mm 55 GR, FMC | 3000 ft./sec. + 100-0 |

| LEVEL IV | |
|---|---|
| Caliber and Bullet Type | Bullet Velocity |
| 7.62 × 63 mm 166 GR, M2 AP | 2880 ft./sec. + 30-0 |
| 7.92 × 57 mm GR, mild steel core (LPS) | 2415 ft./sec. + 100-0 |
| 7.62 × 54R mm 155 GR, steel case, armor piercing incendiary B32 | 2850 ft./sec. + 100-0 |
| 7.62 × 54R mm 184 GR, steel case, armor piercing B30 | 2850 ft./sec. + 100-0 |
| 7.62 × 54R mm 130 GR, steel case, armor piercing incendiary type 53 | 2675 ft./sec. + 100-0 |
| 7.62 × 54R mm 148 GR, steel case, hardened steel core type 53 | 3000 ft./sec. + 100-0 |
| 7.62 × 54R mm 147 GR, steel case, mild steel core (LPS) | 2723 ft./sec. + 100-0 |
| 7.62 × 51 mm 151 GR, M61 AP | 2800 ft./sec. + 100-0 |
| 7.62 × 39 mm 120 GR, armor piercing incendiary BZ | 2500 ft./sec. + 50-0 |
| 7.62 × 39 mm 118 GR, armor piercing incendiary type 56 | 2500 ft./sec. + 50-0 |
| 7.62 × 39 mm 122 GR, steel case mild steel core (PS) | 2300 ft./sec. + 100-0 |
| 5.56 × 45 mm 62 GR, M855 (SS109 Green tip) | 3200 ft./sec. + 100-0 |

-continued

| LEVEL IV | |
|---|---|
| Caliber and Bullet Type | Bullet Velocity |
| 5.45 × 39 mm 53 GR, 7N6 | 2920 ft./sec. + 100-0 |
| 5.45 × 39 mm 57 GR, 7N10 | 3051 ft./sec. + 100-0 |

| LEVEL V | |
|---|---|
| Caliber and Bullet Type | Bullet Velocity (min. 3200 ft/sec.) |
| 7.62 × 54R mm 187 GR, steel case, armor piercing incendiary BS40 | Classified |
| 7.62 × 51 mm GR, M948 | Classified |
| 7.62 × 51 mm 126.5 GR, M993 | Classified |
| 5.56 × 45 mm 52.5 GR, M995 | Classified |

Figure 3:
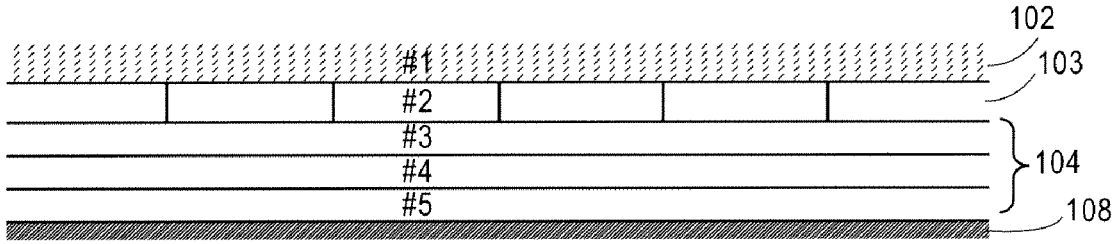
FIG. 3 is an edge view of a variation of the first embodiment.

The table above shows a configuration of the first embodiment that can defeat all of the above-listed Level III threats, with three glass backing plies (glass #3, #4, and #5). An edge view of such a structure is depicted in FIG. 3. Note how the layer 104 now includes three back-to-back glass backing plies that are bonded to the intermediate layer 103 (via their respective adhesive layers), between the intermediate layer 103 and the anti-spalling layer 108.

In yet another configuration of the first embodiment that was tested, all of the above-listed Level IV threats were defeated when the layer 104 had four back-to-back glass backing plies (glass #3, #4, #5, and #6). The first embodiment was also able to defeat all of the above-specified Level V threats, also using a structure having four glass backing plies in layer 104. However, in that case, the ceramic layer #2 (an example of the intermediate layer 103 with just a single layer of transparent ceramic tiles) had its tile thickness increased to 11 mm and 14 mm.

Figure 2:
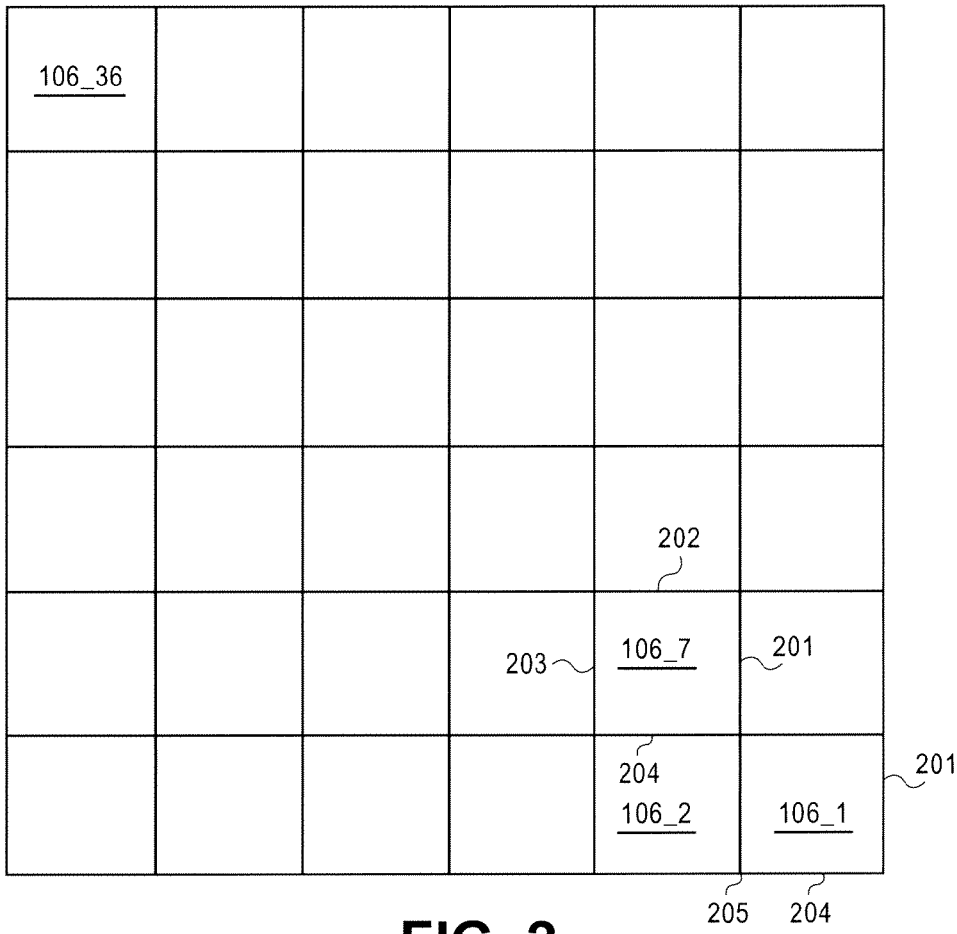
FIG. 2 is a top side view of the first embodiment.

In the first embodiment shown in FIGS. 1 and 2, the arrangement of the tiles in the mosaic-like fashion is in a single layer. As an alternative, the arrangement may be in multiple, stacked sub-layers, where each sub-layer is mosaic-like and parallel to the arrangement in the other sub-layers, with the edges of tiles in one sub-layer not aligned with edges of tiles in another sub-layer.

Figure 4:
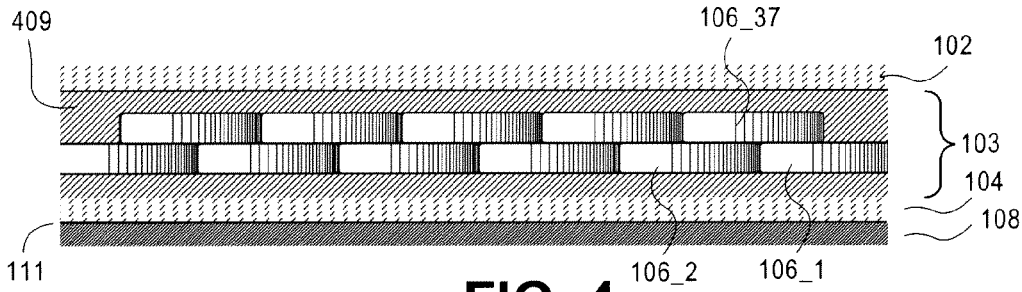
FIG. 4 is an edge view of a second embodiment of the invention.
Figure 5:
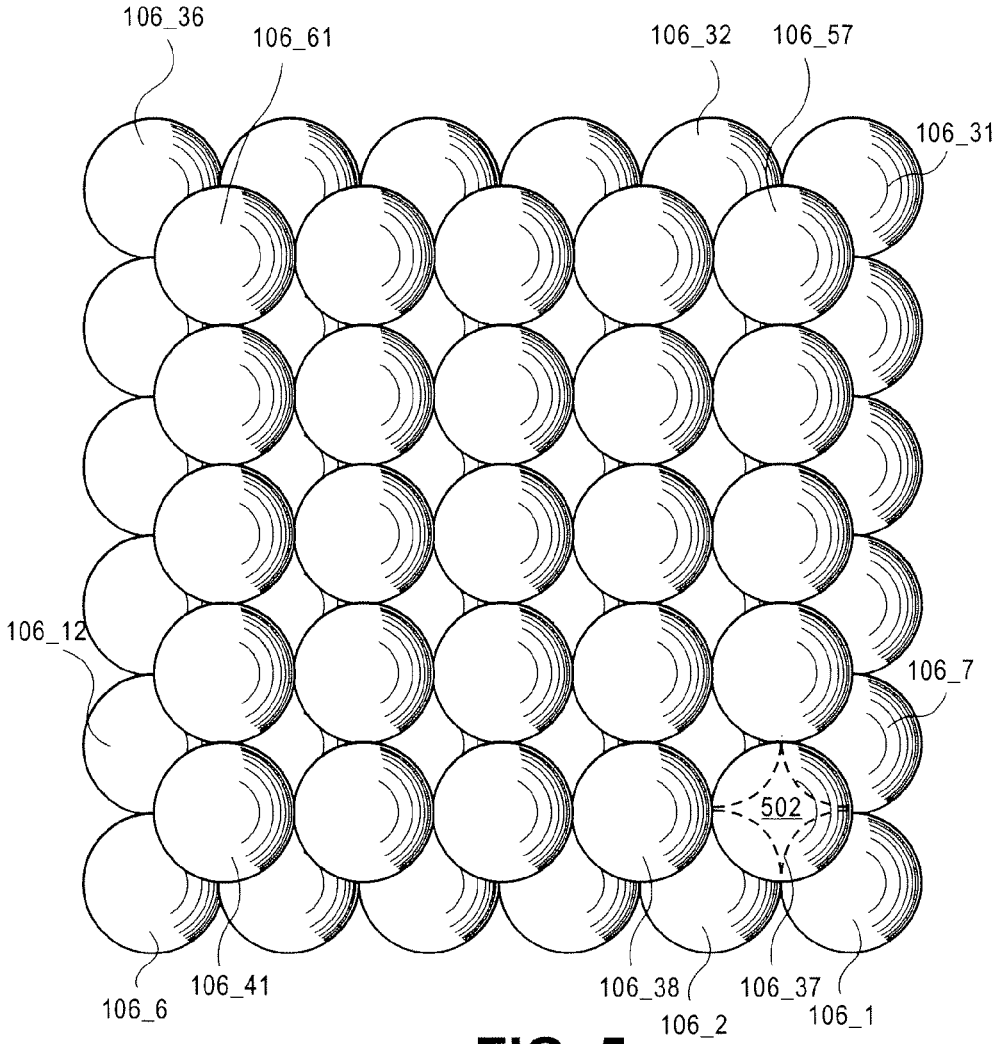
FIG. 5 is a top side view of the second embodiment.

Turning now to the second embodiment of the invention, FIG. 4 shows an edge view of such a structure, while FIG. 5 shows its top (face) view. In this embodiment, the tiles 106 are transparent ceramic disks, which are arranged in two sub-layers that are bonded to each other. Each disk in this case has a uniform thickness (as seen in the edge view of FIG. 4), and each disk preferably has the same dimensions. The lower sub-layer, which, in this case, refers to the layer that is farther from the strike or front face of the structure, is larger and is composed of tiles 106_1, . . . 106_36. This arrangement is mosaic-like, in the sense that the tiles 106_1, . . . 106_36 are laid out in the same plane and abutting each other at their edges. Of course, intervening spaces cannot be eliminated in this case, due to the generally round, and in particular circular, boundary of each disk.

Positioned above or in front of the lower sub-layer is the upper sub-layer, composed of tiles 106_37, . . . 106_61. The latter are also arranged in a mosaic-like pattern, similar to the lower sub-layer, except that the position of the upper sub-layer is offset relative to the lower sub-layer. This allows each tile in the upper sub-layer to be aligned so as to close off a respective gap in the lower sub-layer, where this gap is between two abutting tiles of the lower sub-layer. For example, the gap 502 (delineated within dotted lines) that is formed as a result of the tiles 106_1, 106_2, 106_7, and 106_8 abutting each other is aligned with tile 106_37. This arrangement of the sub-layers is retained in position preferably by just a single layer of adhesive material that bonds the front face of lower layer to the back face of the upper layer. The adhesive material also preferably fills the gaps between abutting tiles of the upper sub-layer (i.e., the gaps between the tiles 106_37, . . . 106_61). The adhesive material should also be used to fill-in the gaps in the lower sub-layer (between tiles 106_1, . . . 106_36). This aspect is depicted by reference 409 in FIG. 4, referring to the entire volume of adhesive material that fills the space (other than that of the tiles 106) between the first layer 102 and the third layer 104. Note, however, that an additional layer of adhesive material (not shown) may be needed, between the front face of the layer 103 and the back face of the first layer 102 to transition between (or better match) the index of refraction of the two dissimilar materials. A similar transition layer may be added between the back face of the intermediate layer 103 and the front face of the third layer 104.

The thickness of the adhesive layer used to fill-in the gaps of each sub-layer in this embodiment is thus greater than the relatively thin film that is used in the first embodiment (to abut the straight edges of the square tiles together). Also, given the stacking and overlapping condition of the disks in the second embodiment, a relatively thicker adhesive layer may also be needed, to bond the face areas of the transparent ceramic sub-layers to each other. In addition to adhering the transparent ceramic disks in place, the thicker adhesive layer is believed to help in buffering a back face signature deformation due to a ballistic of fragmentation impact. The deformation would appear behind the rear most transparent ceramic sub-layer (in this case composed of tiles 106_1, . . . 106_36) and might include premature cracking, chipping, or nicking of the transparent ceramic which could possibly result in disk dislodgment or turning.

Regarding the adhesives, these may be pourable, or they may be in the form of rolled stock or flat sheets, or they may be injected into a mold such as using a vertical resin transfer molding (VRTM) process. For example, to make the intermediate layer 103, a sufficient amount of adhesive may be poured into a containment area in which the tiles 106 are then laid out. Care should be taken to avoid the formation of air bubbles in the subsequently cured adhesive layers. The curing process may involve simply elapsed time, a UV energy application, and/or a heat and pressure process (e.g., an autoclaving process). One of ordinary skill, once informed by the disclosure here, will readily recognize several different ways of making the intermediate layer 103, and the multi-layer structure as a whole.

Figure 6:
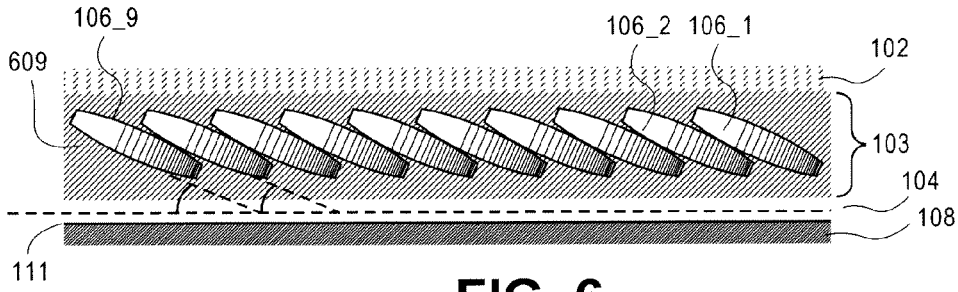
FIG. 6 is an edge view of a third embodiment of the invention.
Figure 7:
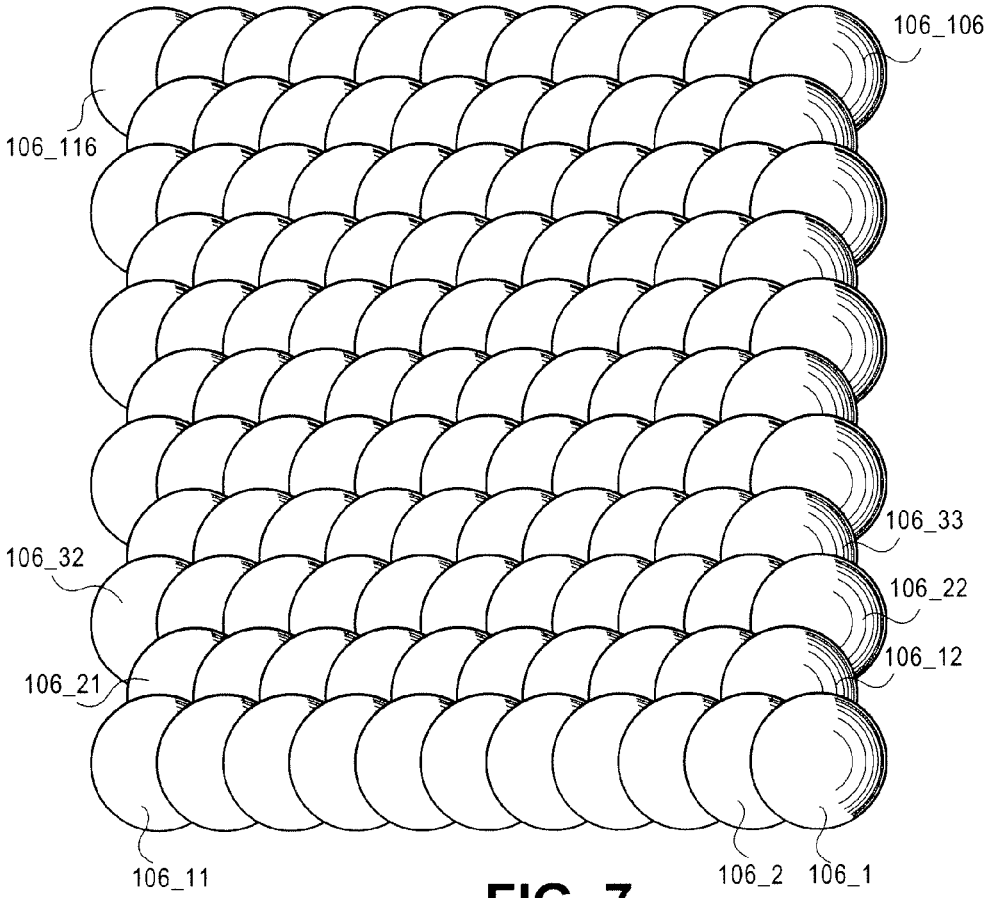
FIG. 7 is a top side view of the third embodiment.

Referring now to FIGS. 6 and 7, these depict edge and face views of the third embodiment of the invention. In this case, each of the tiles 106 is a transparent ceramic disk that preferably has a non-uniform thickness. The tiles 106 are arranged in an imbricated pattern, such that each tile in a row is in substantially a straight line with other tiles in the row, and overlaps a portion of a tile in an adjacent row. For example, each tile in the row of tiles 106_1, . . . 106_11 overlaps a portion of a tile in the adjacent row of tiles 106_12, . . . 106_21.

Viewed another way, the third embodiment has an arrangement of tiles 106, where each tile is a transparent ceramic disk, in which the tiles are arranged in overlapping rows, such that in the interior of a row, a tile overlaps its predecessor in that row and is overlapped by its successor in that row. In addition, a subsequent row overlaps its predecessor and is overlapped by its successor. For example, referring again to FIG. 7, consider the row of tiles 106_12, . . . 106_21, for which the interior tiles are 106_13, . . . 106_20. It can be seen that interior tile 106_20 overlaps its predecessor, namely 106_21, and is overlapped by its successor, namely 106_19. Moreover, this row of tiles overlaps its predecessor row, namely the row of tiles 106_22, . . . 106_2, and is overlapped by its successor row, namely tiles 106_1, . . . 106_11.

As was mentioned above, the tiles 106 of the third embodiment are preferably transparent ceramic disks that have non-uniform thickness. For instance, each disk may have a flat side and an opposite, dome-shaped side. When used in the third embodiment, a dome-shaped side or face of each tile should face the threat side of the structure. Each of the tiles 106 preferably has substantially the same dimensions in order to facilitate the manufacture of the intermediate layer 103. Note that as an alternative, the non-uniform thickness may be obtained by having both sides substantially dome-shaped, such as shown in FIG. 6.

Regardless of the profile of each tile, it is instructive to compare the edge views of the different embodiments of the invention. In the first embodiment, depicted in FIG. 1, the tiles 106 abut each other at their edges. In the second embodiment, the tiles within each sub-layer abut each other at their edges, but due to the generally round boundary or periphery of each tile, a gap is formed between adjacent tiles. The gap is, however, closed off by another sub-layer. In the third embodiment (FIG. 6), the tiles are slanted so that they abut each other on their sides or faces, rather than their edges. The rear face of each tile 106 makes an acute angle with the plane of the third layer 104 (e.g., a glass backing ply). These angles are depicted in FIG. 6. Note that in the third embodiment, the formation of gaps between adjacent tiles is avoided, by virtue of the imbricated pattern in which each tile overlaps a portion of a tile in an adjacent row.

To maintain the arrangement of the tiles 106 in the intermediate layer 103 of the third embodiment, the entire volume of that layer, except for the tiles 106, may be filled with a volume 609 of adhesive material (that may be selected from the list given above). This material should be selected to have an index of refraction that will match that of the tiles 106, to improve transparency of the overall structure. As in the first and second embodiments, the intermediate layer 103 of the third embodiment may be sandwiched between the first layer 102 and the third layer 104. Each of these latter layers may have a respective, rigid panel made of glass whose area is large enough so that the panel is co-extensive, at its periphery, with the layer 103 (as shown in FIG. 6). This enables the structure as a whole to be easily installed within a window frame, supported by the window frame system near its periphery just like a conventional security glazing.

Based upon experimental and simulated results of subjecting the different embodiments of the invention to the various ballistic threat levels defined above, the following characteristics of the transparent ceramic tiles are desirable.

First, there is a minimum tile mass that helps maintain integrity of the tile following impact. This translates into a minimum tile thickness and a minimum tile facial area (e.g., corresponding to a minimum diameter for the second and third embodiments that use disks). Second, with respect to the third embodiment in which disks that have non-uniform thickness and in particular a dome-shaped front face, this dome-shaped surface should be optimized to enhance yaw into the projectile upon impact. Because of the slight tilt of each overlapping disk in the imbricated pattern, a perpendicular projectile impact, that is an impact that is perpendicular to the plane of the disk, is highly unlikely. Accordingly, some of the energy of the projectile is expended in deflection, yawing, and lateral shear loading of the projectile core. If the tiles are discus shaped where both sides are dome-shaped, they collectively help in this process as the system flexes upon impact, which in turn forces the projectile to initiate penetration at an obliquity due to the base of the projectile shifting into the penetration phase. The shifting occurs once if the disks are struck once in their center, or two times if in an overlapped disk region. The discus shape, the tapering of the thickness, and the forming of a non-planar incline surface all work together to render a true zero degree obliquity impact highly unlikely.

Also, the surface area (of the front face) of the tile should be optimized to maintain full contact with the projectile upon impact, regardless of the angle of incidence. For instance, based upon the typical length of a 7.62 mm/.30 caliber military bullet, which is approximately 1.03 inches, a 2 inch diameter (circular) disk, or larger, is preferred so as to be susceptible to less total fracture and localized compression damage to both the impacted disk and those in which it was in contact with.

To improve the success rate in creating gross destruction of the projectile and its core, the radius of the dome-shaped face should also be optimized as a function of the types of projectiles expected and their velocities. For example, to defeat a typical civilian law enforcement 7.62 mm Level III ball ammunition threat, the radius should be about 8.62 inches. For military 7.62 mm Level III threats, the preferred radius is about 10.16 inches. For a typical military Level IV armor piercing hardened steel core threat, the preferred radius is about 6.26 inches. This shows just how much a relatively small dimensional variance can induce a substantial impact on the capability to defeat the projectile (where the discus shaped transparent ceramic tile is used).

It may also be estimated that, for the third embodiment, relatively thinner disks may be used as compared to a conventional, larger area but monolithic (or "flat") ceramic tile structure. It may be expected that the minimum thickness of the transparent ceramic tiles used in the third embodiment should be at least thirty percent of the thickness of the ceramic layer of an otherwise conventional, monolithic plate construction (for the same specified threat).

Again, for the third embodiment, it may be expected that proportionately, as compared to the monolithic ceramic plate construction, the transparent ceramic disks are at their thickest dimension, approximately twenty-five percent less than the thickness of the equivalent defeating flat ceramic plate (e.g., for a 7.62 mm Level III military threat).

In general, for the first embodiment, tiles from one inch to 4 inches square can be utilized, however the 2 inch tiles are preferred as providing the best overall performance for limiting the amount of cracked and destroyed transparent ceramic material, resulting in a less obscured viewable area. Transparent armor may be designed to resist multiple repeat impacts, because it is important, for instance, for the driver of a vehicle to be able to see through the cracked windshield after impact. The 2 inch tiles also appear to provide a reasonable thickness, and are relatively easy to manufacture and would appear to cost less to produce than larger tiles. The first embodiment is the lowest ballistic performer, however, it is the least costly to produce and is generally the thinnest. The second embodiment is a better ballistic performer, but is more costly to manufacture and is thicker. Finally, the third embodiment appears to be the best ballistic performer, but is the most costly to manufacture, as well as being the thickest.

It has also been found that to increase multiple repeat hit capability in the first embodiment, without undue visual impairment, the transparent armor system should have a further layer of ceramic tiles added (referred to above as multiple sub-layers within the intermediate layer 103).

For the second embodiment where flat, round transparent ceramic tiles were used, once again tiles from one inch to 4 inch diameter can be used, however, the 2 inch flat circular disks appear to have the best compromise for limiting the amount of cracked and destroyed transparent ceramic, resulting in a less obscured viewable area. The third embodiment works best with discus shaped tiles of preferably 2 inches in diameter, although smaller or larger diameter discus shaped tiles can alternatively be used.

The invention is not limited to the specific embodiments described above. For example, in the second embodiment of FIG. 4 and FIG. 5, a material other than adhesive may be used to fill-in some or all of the gaps between the abutting disks of the same sub-layer, as well as the gap that surrounds the "smaller" (in this case, upper) layer. Also, the resulting multi-layer armor structure need not have a perfectly square or rectangular periphery as shown in the figures but instead may be irregular or have multiple segments (e.g., L-shaped; hexagonal; etc.). Accordingly, other embodiments are within the scope of the claims.

What is claimed is:

1. A laminated, optically transparent, ballistic resistant structure comprising:

a first transparent layer;

a second layer of transparent ceramic tiles spread across the first layer; and a third transparent layer, the first and third layers being bonded to opposite sides of the second layer, respectively, by transparent adhesive, wherein the first and third layers are glass layers.

2. The structure of claim 1 wherein the second layer is bonded to the glass layers by respective adhesive layers.

3. The structure of claim 2 wherein the transparent ceramic tiles are made essentially of sapphire.

4. The structure of claim 2 wherein arrangement of the tiles in the second layer is mosaic-like.

5. The structure of claim 4 wherein each of the tiles is a transparent ceramic polygon, the tiles abutting one another to eliminate any intervening spaces between them making the second layer an essential solid of transparent ceramic.

6. The structure of claim 4 wherein each of the tiles is a transparent ceramic polygon with uniform thickness and polished edges, wherein the edges of two abutting tiles are bonded to one another by a layer of adhesive material, wherein the layer of adhesive material and the abutting tiles have indices of refraction that are matched for transparency of the structure.

7. The structure of claim 4 wherein each of the tiles has substantially the same dimensions.

8. The structure of claim 2 wherein the first layer is in front and the third layer is behind the second layer, the structure further comprising a transparent anti-spall layer bonded to the structure behind the third layer.

9. The structure of claim 1 wherein the tiles are arranged in a plurality of sub-layers, the arrangement of tiles in each sub-layer being mosaic-like and parallel to the arrangement in the other sub-layers, with the abutting edges of tiles in one of the sub-layers being offset relative to the abutting edges of tiles in another one of the sub-layers.

10. The structure of claim 1 wherein each of the tiles of the second layer is a transparent ceramic disk, the tiles being arranged in at least two sub-layers bonded to each other, the arrangement of the tiles in each sub-layer being mosaic-like with the two sub-layers being parallel to each other, and wherein the arrangements in the two sub-layers have a relative offset such that a tile in one of the sub-layers is aligned to close off a gap in another one of the sub-layers, the gap being between two abutting tiles of the same sub-layer.

11. The structure of claim 10 wherein the disk has uniform thickness.

12. The structure of claim 1 wherein each of the tiles has substantially the same dimensions, and each tile in one of the sub-layers is aligned with a respective gap in another one of the sub-layers, the respective gap being between two abutting tiles of the same sub-layer.

13. The structure of claim 1 wherein each of the tiles is a transparent ceramic disk, and wherein the tiles are arranged in an imbricated pattern such that each tile in a row is in substantially a straight line with other tiles in the row and overlaps a portion of a tile in an adjacent row.

14. The structure of claim 13 wherein the disk has non-uniform thickness.

15. The structure of claim 14 wherein the disk has a flat side and an opposite, dome-shaped side, the latter facing a threat side of the structure.

16. The structure of claim 13 wherein each of the tiles has substantially the same dimensions.

17. The structure of claim 1 wherein each of the tiles is a transparent ceramic disk, and wherein the tiles are arranged in overlapping rows such that, in the interior of a row, a tile overlaps its predecessor in the row and is overlapped by its successor in the row, and a subsequent row overlaps its predecessor and is overlapped by its successor.

18. An apparatus comprising:

a laminated, visibly transparent structure having the following layers starting from the front and going to the rear, a first rigid panel made of glass, a second rigid panel, the second panel having a plurality of transparent ceramic tiles spread across the first panel, wherein the tiles are bonded to one another to form the second panel, a third rigid panel made of glass, and a sheet of anti-spalling material.

19. The apparatus of claim 18 wherein a rear face of the first rigid panel is bonded to a front face of the second rigid panel by a layer of adhesive that has been spread upon the rear face, the front face, or both.

20. The apparatus of claim 18 wherein the structure further comprises a fourth panel made of glass and laminated between the third panel and the anti-spalling sheet.

21. The apparatus of claim 20 wherein the third panel has a front face that is bonded to a rear face of the second panel by a layer of adhesive that has been spread upon the rear face, the front face, or both.

* * * * *